US009084911B2

(12) United States Patent
Hsu

(10) Patent No.: US 9,084,911 B2
(45) Date of Patent: Jul. 21, 2015

(54) TREADMILL FOR PHYSIOTHERAPY AND METHOD OF TRAINING PATIENT'S LEGS ON THE TREADMILL

(75) Inventor: Ching-Lu Hsu, Taipei (TW)

(73) Assignee: GEE HOO INDUSTRIAL CORP., Taipei (TW)

( * ) Notice: Subject to any disclaimer, the term of this patent is extended or adjusted under 35 U.S.C. 154(b) by 0 days.

(21) Appl. No.: 13/085,664

(22) Filed: Apr. 13, 2011

(65) Prior Publication Data

US 2012/0264573 A1 Oct. 18, 2012

(51) Int. Cl.

| | |
|---|---|
| ***A63B 21/00*** | (2006.01) |
| ***A63B 22/02*** | (2006.01) |
| ***A63B 69/00*** | (2006.01) |
| *A63B 21/16* | (2006.01) |
| *A63B 22/00* | (2006.01) |

(52) U.S. Cl.

CPC ..... *A63B 22/0235* (2013.01); *A63B 21/00181* (2013.01); *A63B 69/0064* (2013.01); *A63B 2021/1609* (2013.01); *A63B 2022/0094* (2013.01); *A63B 2208/0204* (2013.01); *A63B 2208/0233* (2013.01)

(58) Field of Classification Search

USPC ..... 482/54, 51, 52

See application file for complete search history.

(56) References Cited

U.S. PATENT DOCUMENTS

| | | | | |
|---|---|---|---|---|
| 5,492,521 | A * | 2/1996 | Wilkinson et al. | 482/147 |
| 6,450,923 | B1 * | 9/2002 | Vatti | 482/8 |
| 7,594,878 | B1 * | 9/2009 | Joannou | 482/54 |
| 2004/0248699 | A1 * | 12/2004 | Colley | 482/54 |

* cited by examiner

*Primary Examiner* — Jerome w Donnelly

(74) *Attorney, Agent, or Firm* — Tracy M. Heims; Apex Juris, PLLC

(57) ABSTRACT

A treadmill for physiotherapy includes a base frame, a support apparatus, and a control apparatus. The base frame has an endless belt and a pair of rails on opposite sides of the belt. The support apparatus is engaged with the rails for reciprocation along the rails. The control apparatus has may adjust the height, direction and location of the support apparatus that that user may sit on the support apparatus and put the feet on the belt to take exercise for physiotherapy.

13 Claims, 8 Drawing Sheets

TREADMILL FOR PHYSIOTHERAPY AND METHOD OF TRAINING PATIENT'S LEGS ON THE TREADMILL

BACKGROUND OF THE INVENTION

1. Field of the Invention

The present invention relates generally to a treadmill, and more particularly to a treadmill capable of taking exercise for physiotherapy on it and a method of training legs on such treadmill.

2. Description of the Related Art

A conventional treadmill is provided with an endless belt that user may stand on the belt to run. Some treadmills are provided with a motor to drive the belt, and sometime, such treadmill may be used for physiotherapy, especially for training leg's muscles.

For a leg injury patient, bike and treadmill are the common equipment that doctor will ask patient to take excise on it for physiotherapy. When a patient takes exercise on a treadmill, he/she has to stand on the belt of the treadmill and hold the handles on opposite sides of the belt to sustain his/her body and walk or run on the belt. This is very dangerous for a leg injury patient because he/she only uses arms to sustain body and the injured leg(s) cannot do anything. Once the patient slides or losses balance, he/she may fall down on the treadmill and cause another serious injury.

SUMMARY OF THE INVENTION

The primary objective of the present invention is to provide a treadmill for physiotherapy to provide patient to take exercise on it in a safe way.

According to the primary objective of the present invention, a treadmill for physiotherapy includes a base frame, a support apparatus, and a control apparatus. The base frame has an endless belt and a pair of rails on opposite sides of the belt. The support apparatus has a base with two engagement portions to be engaged with the rails that the base is slidable along the rails, a frame connected to the base, and a seat connected to the frame that user sits on the seat to put feet on the belt. The control apparatus has a controller to be move between a first position and a second position, a connector connected to the controller, and a fixer connected to the connector, wherein the fixer is received in the rail and has a fixing portion. The fixing portion of the fixer is engaged with the rail when controller is moved to the first position, and the fixer is disengaged with the rail when controller is moved to the second position.

The secondary objective of the present invention is to provide a method of training legs for physiotherapy on the treadmill.

According to the primary objective of the present invention, a method for physiotherapy on the treadmill includes the steps of 1). turning on a power of the treadmill; 2) controlling the belt to run in a predetermined speed to move user's feet in a predetermined direction; 3) lifting the feet from the belt, and then moving the feet back and touching the belt again; 4) repeating the second step and the third step; and 5) turning off the power of the treadmill.

In an embodiment, the user may take exercise for physiotherapy in a sit posture or a stand posture.

DETAILED DESCRIPTION OF THE INVENTION

Figure 6:
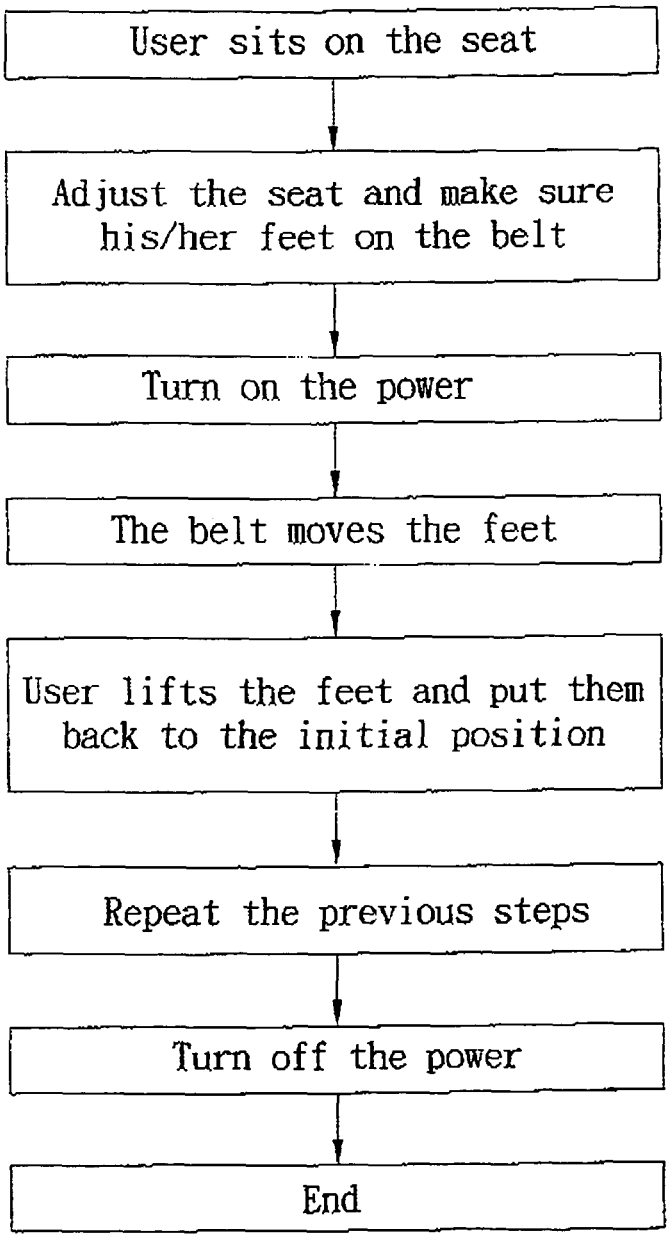
FIG. 6 is a flow diagram of the procedure of taking exercise for physiotherapy by the treadmill of the first preferred embodiment of the present invention.
Figure 7:
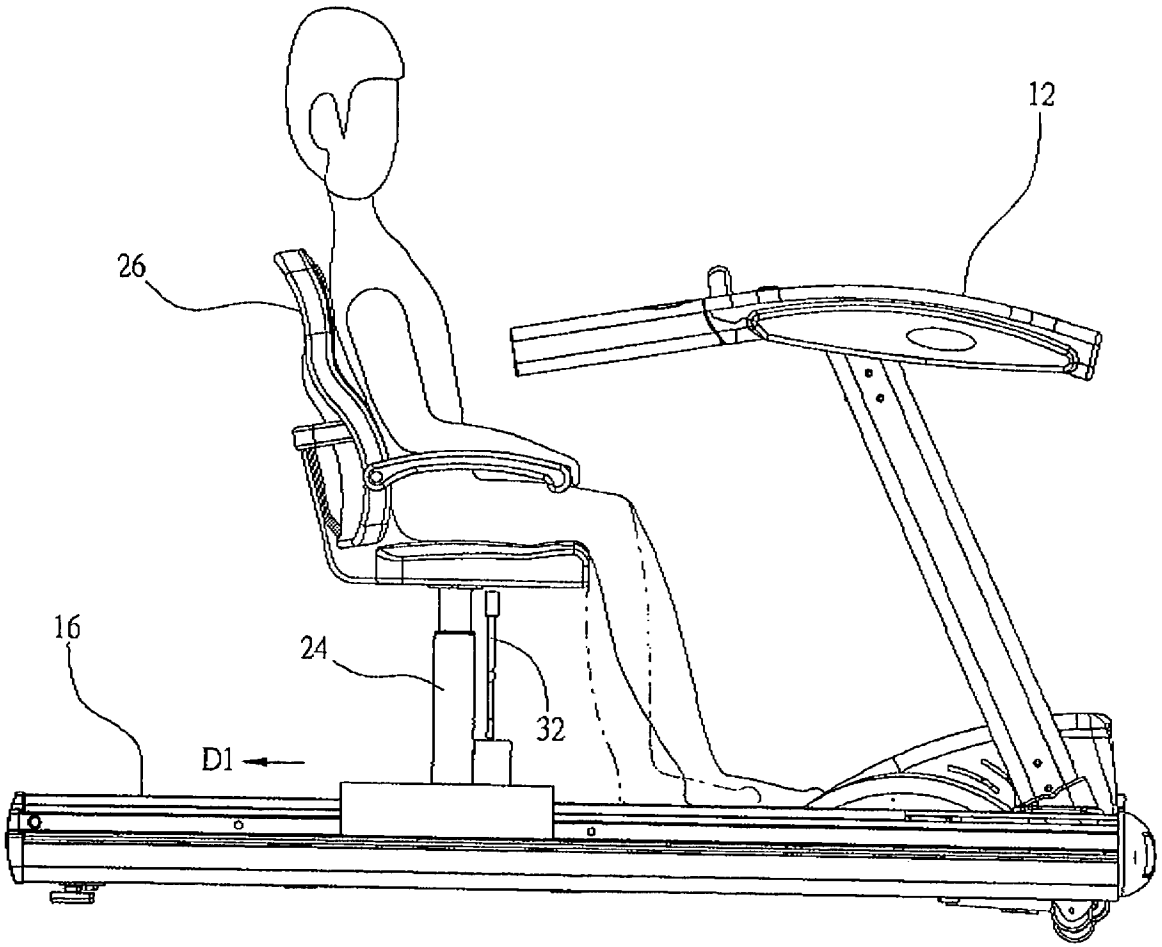
FIG. 7 is similar to FIG, showing a patient facing the panel to take exercise on the treadmill of the first preferred embodiment of the present invention.
Figure 8:
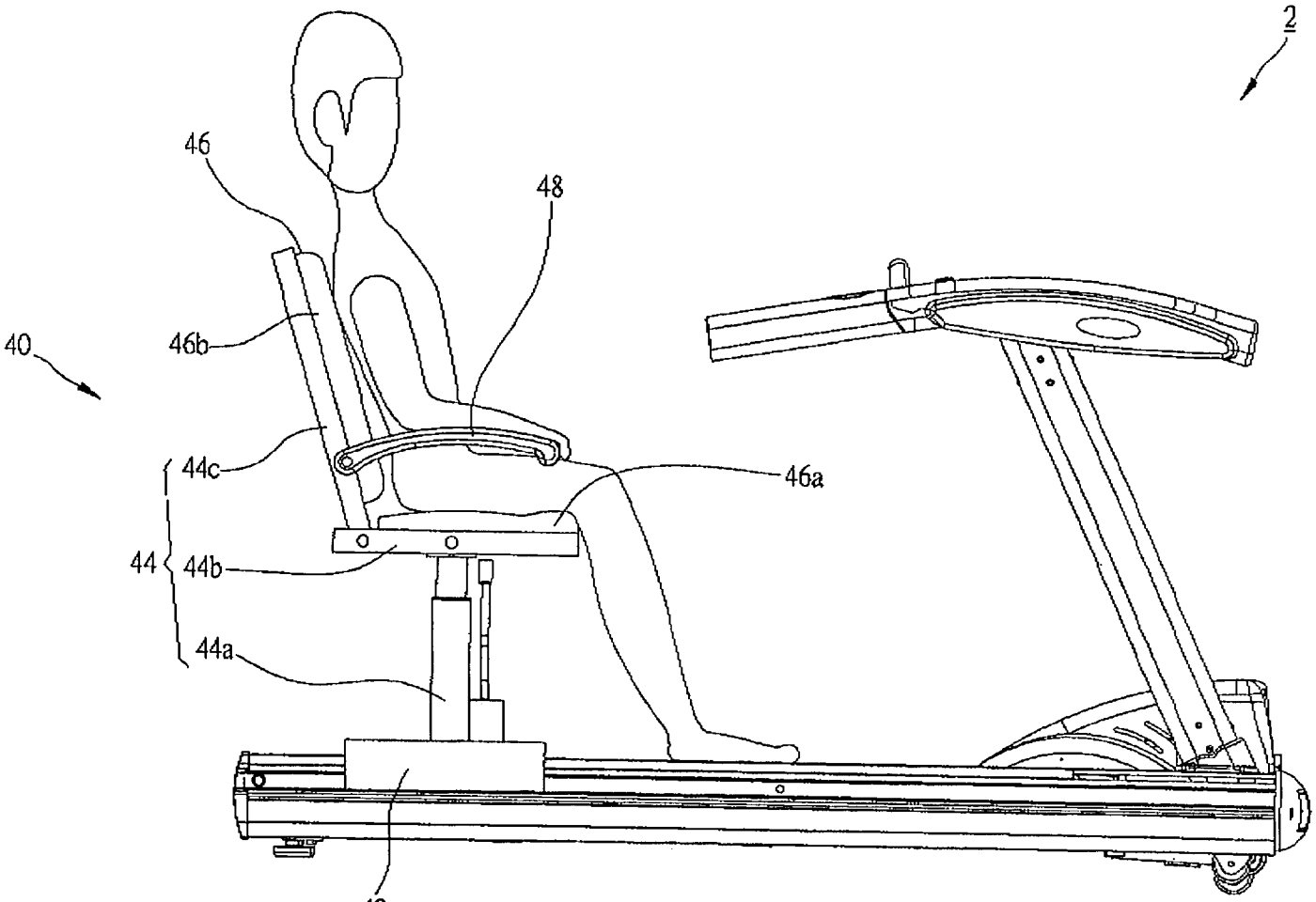
FIG. 8 is a lateral view of the treadmill of a second preferred embodiment of the present invention, on which a patient sits on the treadmill to take exercise.

As shown in FIG. 6 to FIG. 8, the first preferred embodiment of the present invention provides a treadmill 1, which includes a base frame 10, a support apparatus 20, and a control apparatus 30.

The base frame 10 has a panel 12 at a front. The panel 12 has a power switch 12*a* to turn on or turn off the power. The base frame 10 has two parallel rails 14 on opposite sides, and one of the rails 14 is provided with a plurality of bores 14*a*. An endless belt 16 is provided on the base frame 10 to be driven and controlled by the panel 12 to run in a forward direction D1 and a backward direction D2. The speed of the belt 16 may be controlled by the panel 12 also.

The support apparatus 20 includes a base 22, a frame 24, and a seat 26.

Figure 3:
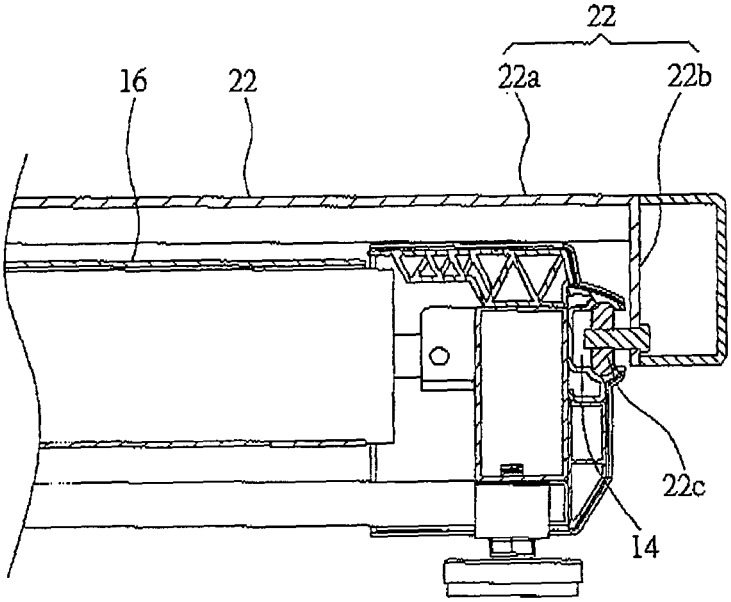
FIG. 3 is a sectional view along the 3-3 line of FIG. 1.

As shown in FIG. 3, the base 22 has a main board 22*a* cross the belt 16 and two side boards 22*b* on opposite ends of the main board 22*a*. The base 22 is provided with an engagement portion, which is a plurality of rollers 22*c* provided on inner sides of the side boards 22*b*, to be engaged with the rails 14 that the base 22 may slide along the rails 14. On one of the lateral boards 22*b* is provided with an opening 22*d*.

The frame 24 has a vertical tube 24*a*, a seat tube 24*b*, an adjustment device 24*c*, a back shaft 24*d*, and a support device. The vertical tube 24*a* is fixed on the main board 22*a* of the base 22. The seat tube 24*b* has an end connected to the seat 26 and the other end inserted into the vertical tube 24*a* that the seat 26 may turn. The adjustment device 24*c* is provided at a bottom of the seat 26 to fasten the seat 26 and adjust the height of the seat 26 by operating a pole. The back shaft 24*d* is connected to the seat tube 24*b* and extends upwards. The handles 24*e* are connected to the back shaft 24*d*.

The seat 26 includes a seat pad 26*a* and a back 26*b*. The seat pad 26*a* is connected to the eat tube 24*b* for user to sit thereon. The back 26*b* is connected to the back shaft 14*d* for user to rest his/her back thereon. The seat 26 further has two armrests 24*e* connected to the back 26*b*. The seat 26 may be turned and adjusted the height of the seat pad 26 to help user to sit down and stand up.

The control apparatus 32 includes a controller 32, a connector 34, a fixer 36, and a spring 38.

Figure 1:
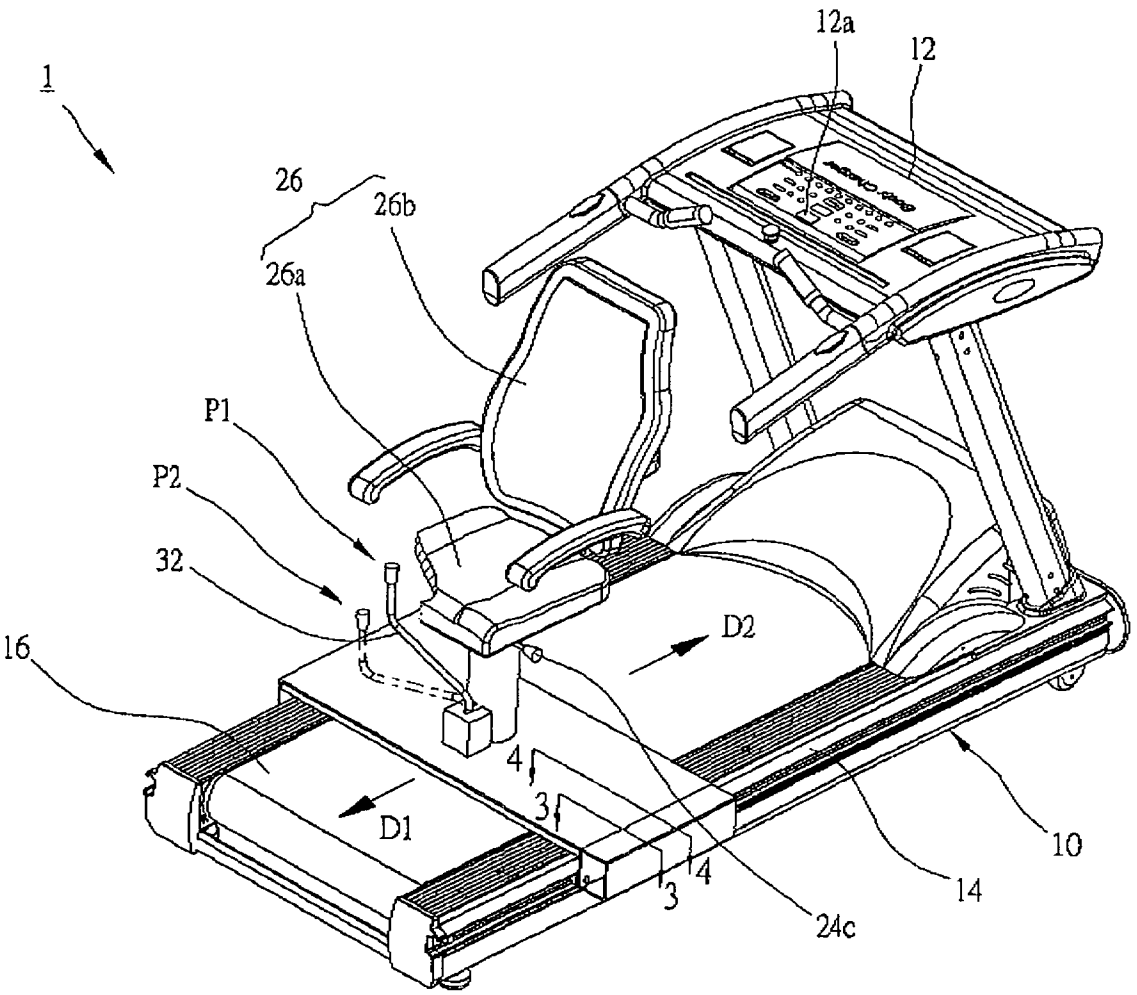
FIG. 1 is a perspective view of the treadmill of a first preferred embodiment of the present invention.
Figure 2:
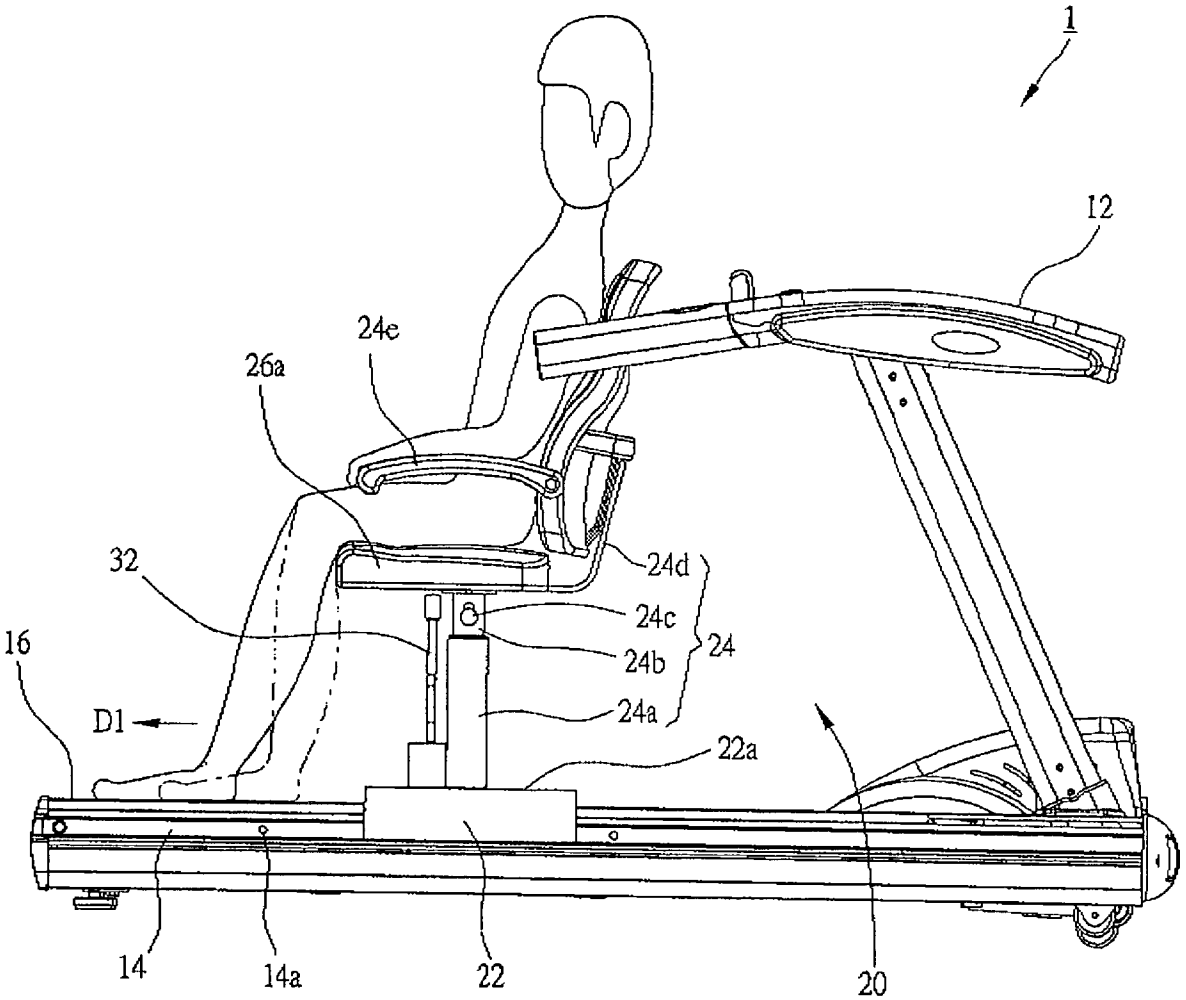
FIG. 2 is a lateral view of the treadmill of the first preferred embodiment of the present invention, on which a patient is taking exercise.

The controller 32 is a shaft movably mounted on the base 22. The controller 32 is under the seat 26 to be manipulated by user. The controller 32 may be moved between a first position P1 (shown as the continuous line in FIG. 1) and a second position P2 (shown as the dot line in FIG. 1).

The connector 34 is a cable with opposite ends connected to the controller 32 and the fixer 36.

Figure 4:
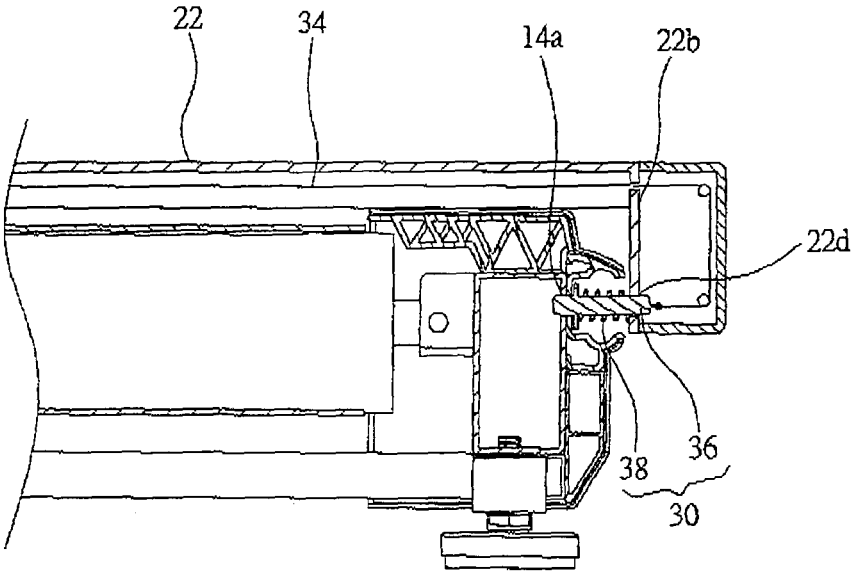
FIG. 4 is a sectional view along the 4-4 line of FIG. 4, showing the fixer engaged with the bore.
Figure 5:
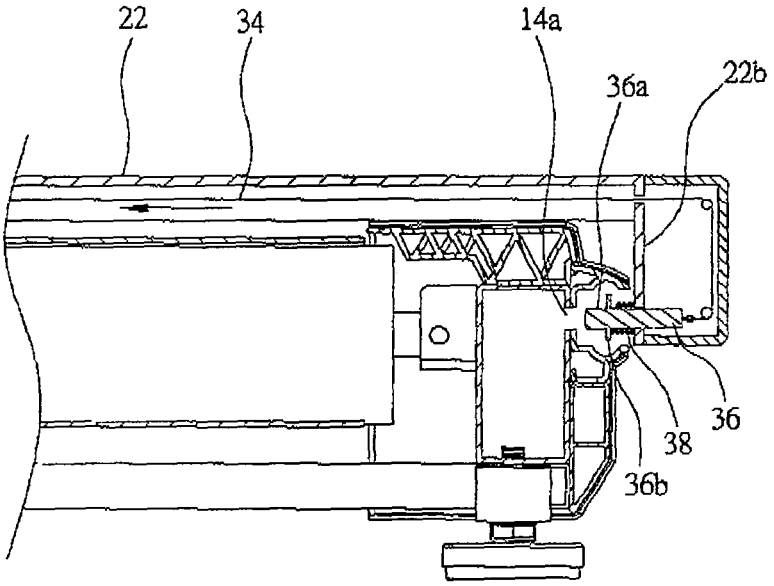
FIG. 5 is similar to FIG. 4, showing the fixer disengaged with the bore.

The fixer 36 is a pin to be inserted into the opening 22*d* of the base 22 and one of the bores 14*a* of the base frame 10 when the controller 32 is moved to the first position P1, as shown in FIG. 4, that the base 22 is fixed on the base 10. A fixing portion 36*a* at a front end of the fixer 36 is disengaged with the bore 14*a* when the controller 32 is moved to the second position P2, as shown in FIG. 5, that the base 22 is free to slide on the base frame 10.

The spring 38 is fitted onto the fixer 36 with opposite ends urging an inner side of the side board 22*b* of the base 22 and a protrusion 36*b* of the fixer 36 to urge the fixer 36 toward the base frame 10.

Now, we explain how to use the treadmill of the present invention for leg physiotherapy.

As shown in FIG. 2 to FIG. 6, the user sits on the seat 26 (back to the panel 12) and put his/her toes or soles on the belt 16. Next, start the treadmill 1 to drive the belt 16 running in the forward direction D1 and in a constant speed that user's feet will be moved distally by the belt 16. Next, user has to lift his/her legs and put them back to the initial position to let the belt move the feet again. Repeat the above steps, the user may train his/her leg's muscles for physiotherapy. After a setting time for physiotherapy, he/she may turn off the power to stop the belt 16.

The advantages of the treadmill 1 of the present invention are:

1. The control apparatus 30 may adjust the support apparatus to have a suitable height and position for the user's body scale that the user may take exercise for physiotherapy on the treadmill 1 of the present invention in a safe way.

2. In the description, the legs are move distally. However, the seat 26 may be turned for 180 degrees, as shown in FIG. 7, that user's legs will be moved proximally by the belt 16 when the belt 16 are running in the forward direction D1. It will have a different effect on training leg's muscles.

3. It may change the direction of the belt 16 moving the legs by changing the running direction of the belt 16 (from the forward direction D1 to the backward direction D2) rather than by turning the seat 26.

In conclusion, the treadmill 1 of the present invention may provide user to take exercise for physiotherapy in a sit posture that is safer for the patient who cannot stand on the treadmill alone. However, for a patient who can stand by himself/herself, he/she can stand on the treadmill of the present invention by holding the handles 24*e* to take exercise for physiotherapy. FIG. 8 shows a treadmill 2 of the second preferred embodiment of the present invention, which is similar to the treadmill 1 of the first preferred embodiment, including a base frame 42, a frame 44, and two handle 48 to construct a support apparatus. However, the frame 44 of the second preferred embodiment has a different structure.

The frame 44 includes a main shaft 44*a*, a first shaft 44*b*, and a second shaft 44*c*. The main shaft 44*a* has an end connected to the base frame 42, and the first shaft 44*b* has an end pivoted on the other end of the main shaft 44*b*, and the second shaft 44*c* has an end pivoted on the other end of the first shaft 44*b*. A seat 46 has a seat pad 46*a* connected to the first shaft 44*b* and a back 46*b* connected to the second shaft 44*c*.

Figure 9:
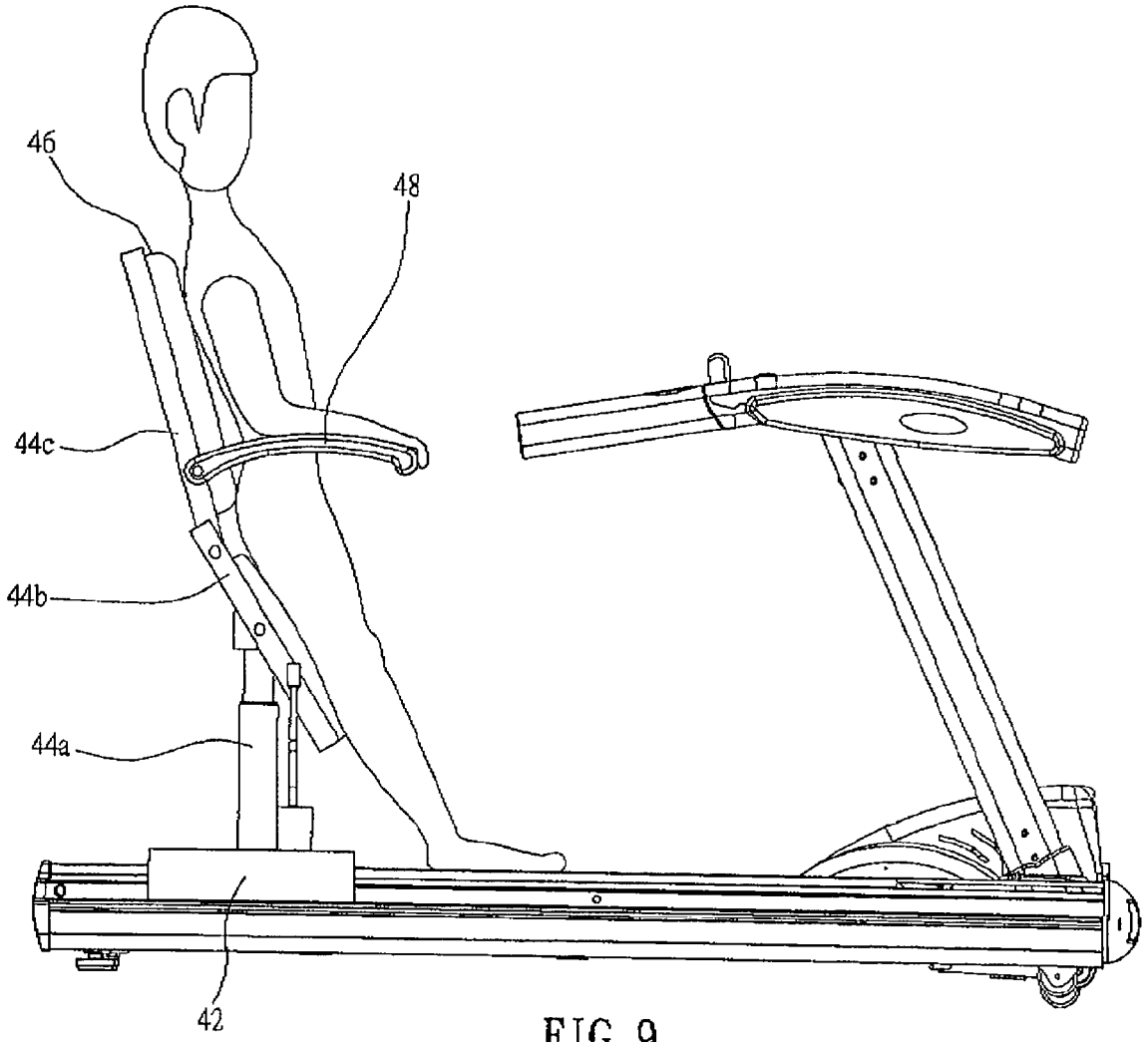
FIG. 9 is a lateral view of the treadmill of a second preferred embodiment of the present invention, on which a patient stand on the treadmill to take exercise.

In the second preferred embodiment, an angle between the seat pad 46*a* and the back 46*b* is adjustable that the seat 46 may be adjusted into a shape as shown in FIG. 9. User may lean on the seat 46 and hold the handles 48 to take exercise for physiotherapy.

The description above is a few preferred embodiments of the present invention. These equivalences of the present invention are still in the scope of claim construction of the present invention.

What is claimed is:

1. A treadmill for physiotherapy, comprising:

a base frame having an endless belt and a pair of rails on opposite sides of the belt;

a support apparatus having a base with two engagement portions to be engaged with the rails that the base is slidable along the rails, a frame connected to the base, and a seat connected to the frame that user sits on the seat to put feet on the belt; and a control apparatus, which is connected to the support apparatus, having a controller to be move between a first position and a second position, a connector connected to the controller, and a fixer connected t the connector, wherein the fixer is received in the rail and has a fixing portion;

wherein the fixing portion of the fixer is engaged with the rail when controller is moved to the first position, and the fixer is disengaged with the rail when controller is moved to the second position.

2. The treadmill as defined in claim 1, wherein the frame includes a vertical tube connected to the base frame and a seat tube inserted into the vertical, and the seat is connected to the seat tube that the seat is capable of turning.

3. The treadmill as defined in claim 2, wherein the support apparatus includes an adjustment device to fix the seat.

4. The treadmill as defined in claim 1, wherein the frame includes a main shaft connected to the base, a first shaft pivoted on the main shaft, and a second pivoted on the first shaft, and the seat has a seat pad connected to the first shaft and a back connected to the second shaft.

5. The treadmill as defined in claim 1, wherein the support apparatus has a support device for user to hold his/her body.

6. The treadmill as defined in claim 5, wherein the support device has two handles connected to the frame.

7. The treadmill as defined in claim 1, wherein the base frame is provided with a plurality of bores on a sidewall of the rail, and the base has an opening, and the fixer is a pin to be inserted into the bore and the opening, and the pin is fitted with a spring with opposite ends urging the base and the pin.

8. A method of training legs on a treadmill for physiotherapy, wherein the treadmill includes a base frame, an endless belt on the base frame, and a support apparatus movably mounted on the base frame to support a user to put his/her feet on the belt, the method comprising the steps of:

turning on a power of the treadmill;

controlling the belt to run in a predetermined speed to move user's feet in a predetermined direction;

lifting the feet from the belt, and then moving the feet back and touching the belt again;

repeating the second step and the third step; and turning off the power of the treadmill.

9. The method as defined in claim 8, wherein the support apparatus has a seat for the user to sit thereon and put the feet on the belt.

10. The method as defined in claim 8, wherein the support apparatus has a support device for the user to hold the support device to stand on the belt and walk.

11. The method as defined in claim 8, wherein the belt moves the feet distally, and then the user moves the feet proximally.

12. The method as defined in claim 8, wherein the belt moves the feet proximally, and then the user moves the feet distally.

13. The method as defined in claim 8, wherein the user faces a direction of the belt running.

* * * * *